US006047576A

United States Patent [19]

Lanigan et al.

[11] Patent Number: 6,047,576

[45] Date of Patent: Apr. 11, 2000

[54] SECURITY SYSTEM FOR ROLL-DOWN LOADING DOORS

[76] Inventors: William P. Lanigan, 16946 Blue Heron Dr., Orland Park, Ill. 60462; Peter W. Mirabella, 7647 Starling Dr., Schererville, Ind. 46375

[21] Appl. No.: 08/963,604

[22] Filed: Oct. 31, 1997

Related U.S. Application Data

[63] Continuation-in-part of application No. 08/822,436, Mar. 21, 1997, and a continuation-in-part of application No. 08/895,882, Jul. 17, 1997, Pat. No. 5,931,033.

[51] Int. Cl.[7] ..... E05B 47/00

[52] U.S. Cl. ..... 70/279; 70/256; 70/99; 292/54

[58] Field of Search ..... 70/95–100, 279, 70/264, 256; 292/46–48, 53, 54, 216–218, 207, DIG. 32, DIG. 36, DIG. 42, DIG. 43, DIG. 46, DIG. 60; 296/181, 183, 138, 155

[56] References Cited

U.S. PATENT DOCUMENTS

| | | | |
|---|---|---|---|
| 3,670,536 | 6/1972 | Klebba | 70/99 |
| 3,705,505 | 12/1972 | Landow et al. | 70/99 |
| 3,851,905 | 12/1974 | Klebba | 292/207 X |
| 4,263,795 | 4/1981 | Van Gompel | 70/99 |
| 4,422,313 | 12/1983 | VanderWyde | 70/99 X |
| 4,782,674 | 11/1988 | Johnson | 70/95 |
| 4,943,110 | 7/1990 | Pastva | 296/181 |
| 5,064,228 | 11/1991 | Bisbing | 292/54 |
| 5,392,025 | 2/1995 | Figh et al. | 70/264 X |

*Primary Examiner*—Suzanne Dino Barrett
*Attorney, Agent, or Firm*—G. Cunningham

[57] ABSTRACT

A security system for roll-down loading doors, having: a substantially narrow profile housing adapted to being connected to a wall of a cargo carrying enclosure; an actuator having a key receptacle including a pivotable arm, for moving a latch structure between a locked position and an unlocked position; the latch structure being generally triangular with a top portion being hingably connected to the housing with a stationary pivot pin and the actuator being coupled by a linkage mechanism, the latch structure is adapted to be connected to a loading door of a cargo carrying enclosure when the latch structure is in the locked position and withdrawn from the door when the latch structure is in the unlocked position; and the linkage mechanism includes a distal section having a port and a proximal section having a second port, the distal section is coupled to a middle portion of the latch structure with a first pivot pin and the proximal section is coupled with the linkage mechanism with a second pivot pin, the linkage mechanism and pivotable arm define a substantially rigid link defined by the linkage mechanism and pivotable arm being substantially aligned when the latch structure is in the locked position and the linkage mechanism and pivotable arm being substantially perpendicular when the latch structure is in the unlocked position.

15 Claims, 12 Drawing Sheets

SECURITY SYSTEM FOR ROLL-DOWN LOADING DOORS

This application is a continuation in part of Ser. No. 08/822,436, filed Mar. 21, 1997 and also a continuation in part of Ser. No. 08/895,882, filed Jul. 17, 1997, now U.S. Pat. No. 5,931,033.

FIELD OF THE INVENTION

This invention relates to security systems, and particularly to retrofitable and factory installable security systems for roll-down loading doors.

BACKGROUND OF THE INVENTION

Security for trailers, ISO containers, domestic containers, cargo carrying containers and the like has been quite poor, usually consisting of a padlock and/or seal having an exposed link which can be cut by bolt cutters or equivalent tools. Thus, semi-trailers, containers and trucks left unattended for any length of time, as over night in truck terminals, intermodal terminals and freight yards, on shipping docks and piggy-back railroad cars, or at industrial or commercial loading areas (and during transit), are vulnerable to thievery and pilferage.

The problem of vulnerability of externally located closure means may be minimized, through the employment of a retrofitable or factory installed security system adapted to be located within a container, where it is not clearly visible and accessible to a would be thief or opportunist.

There is an ever demanding requirement for improved security systems for cargo loading doors and enclosures for the worldwide transportation industry.

BRIEF DESCRIPTION OF THE DRAWINGS

(FIG. 2 is in the unlocked position), in accordance with the present invention;

DETAILED DESCRIPTION OF THE PREFERRED EMBODIMENT

Figure 10:
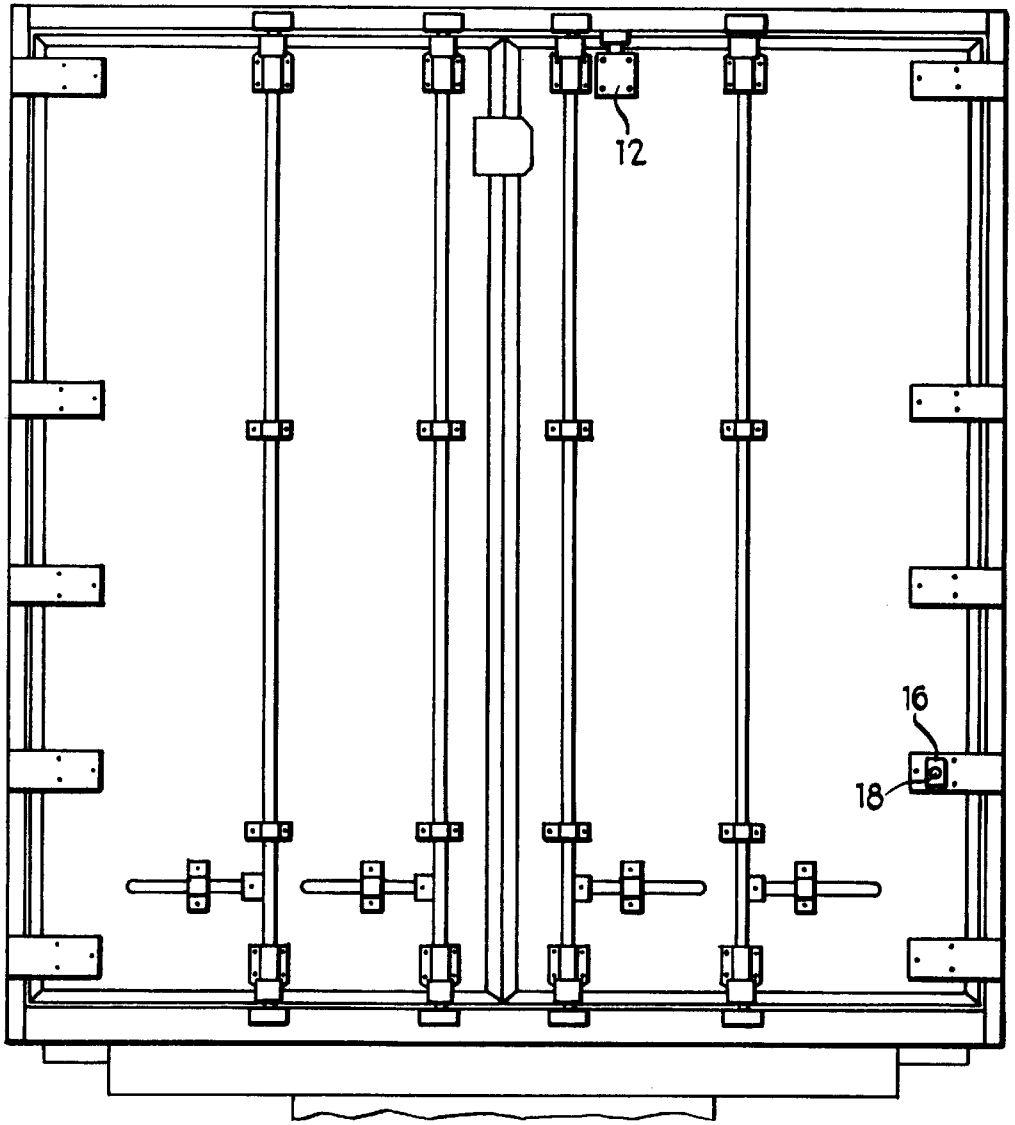
FIG. 10 is a planar, outside view of a container, trailer or other similar enclosed body, showing the embodiment of the security system for cargo loading doors in FIG. 1, showing an exemplary placement of a lock housing with a remote key receptacle coupled with a push-pull cable, in accordance with the present invention.

A security system with an improved lock assembly 10 is shown in the figures, and is particularly adapted for use in connection with cargo loading doors. In one embodiment, the security system 10, includes: a substantially narrow profile housing 12 adapted to being connected to an inside of a cargo loading door 14; an actuator 16 having a key receptacle 18, for moving a latch structure between a locked position 20 and an unlocked position 22; the latch structure 30 and the actuator 16 being coupled by a linkage mechanism 32 and plunger assembly 34, the latch structure 30 is adapted to be at least partially received in a header 36 of at least one of an ISO container, domestic container, semi-trailers, cargo carrying enclosures and the like, when the latch structure 36 is in the locked position 20 and withdrawn from the header 36 when the latch structure 36 is in the unlocked position 22; and the linkage mechanism 32 includes a distal section 38 and a proximal section 40 connected by a middle pivot pin 42, the distal section 38 is coupled to the latch structure 30 with an upper pivot pin 44 and the proximal section 40 is coupled with the plunger assembly 34, the proximal section 40 is also pivotably connected to the housing 12 with a stationary pivot pin 46, the linkage mechanism 32 defines a simulated rigid link defined by the proximal section 40 and distal section 38 being substantially aligned when the latch structure 30 is in the locked position 20.

Advantageously, the security system 10 is configured to be tamper resistant because of it's placement which is substantially internal to a container. In addition, system 10 has a narrow profile to minimize intrusion into the valuable cargo space of the container.

In one embodiment, only one housing 12 with latch structure 30 is necessary, to lock two doors when utilized with a door retainer or the like, which provides simplicity of design. As should be understood, other embodiments can include a plurality of housings and latch structures.

As should be understood, the system 10 can be used with roll down doors, swing out doors and the like, depending on the application.

Figure 1:
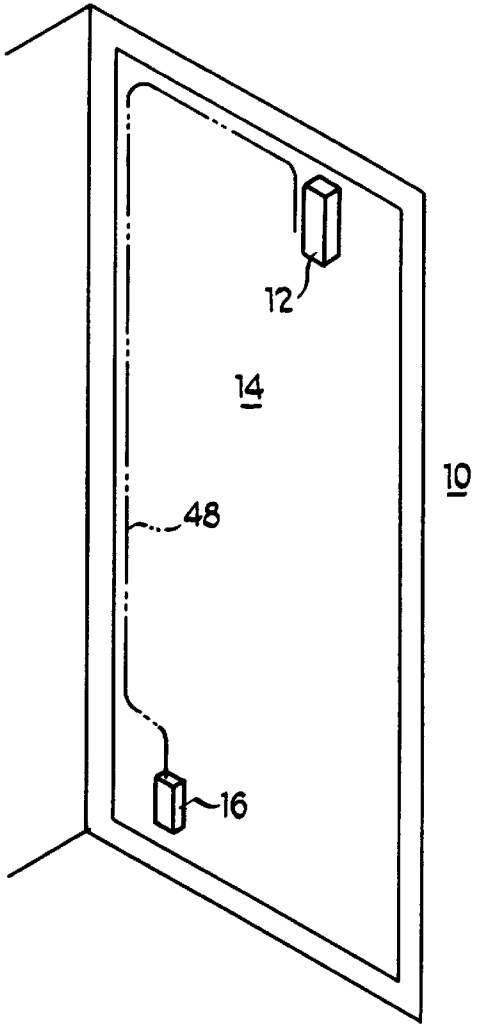
FIG. 1 is a rear, inside view of a container or other similar enclosed body, showing one embodiment of a security system for cargo loading doors showing a lock housing with a remote key receptacle coupled with a push-pull cable, in accordance with the present invention.

In a preferred embodiment, the housing 12 is adapted to be connected to an inside of a cargo loading door, such as positioned at the top right corner, as shown in FIG. 1. This remote placement is out of the way so as not to interfere with the loading and unloading operation. Additionally, the strategic positioning and locations f the components in FIG. 1, provide an improved tamper resistant security system, preferably with internal placement of system 10, so as to be visually hidden from an opportunist or thief. With the housing 12 near a top of the door, it is more difficult to gain easy access, by a would be thief.

As best shown in FIGS. 15–23, a universal adapter comprising a base plate and housing with a slidable and snap fitable arrangement connectable with the base plate is shown. This arrangement provides for ease of installation, assembly and maintenance. In a preferred embodiment, the housing 12 includes a guard 54 for the latch, for protection from damage from shifting loads, for example. Also in a preferred embodiment, the housing 12 is configured to be connected to a base plate 60 ( FIGS. 15 and 16) with an upwardly extending male member and a bracket or slip on member 59, slidably connected thereto and complementarily configured therewith, and the housing 12 can have snap-fitable members, such as spring loaded locking members 57 connected with outwardly extending anchor members 47 of the base plate 60.

Figure 15:
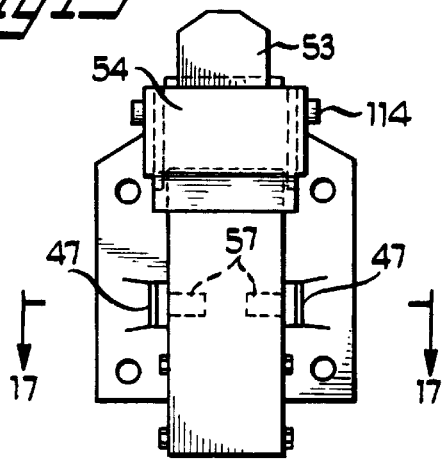
FIG. 15 is a partial front view of the security system in FIG. 1 showing a universal adapter comprising a base plate and housing with a slidable and snap fitable arrangement connectable with the base plate, in accordance with the present invention.
Figure 16:
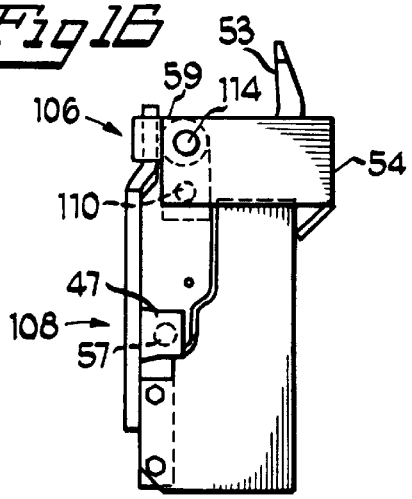
FIG. 16 is a side view of the security system in FIG. 15 showing a universal adapter comprising a base plate and housing with a slidable and snap fitable arrangement connectable with the base plate, in accordance with the present invention.
Figure 18:
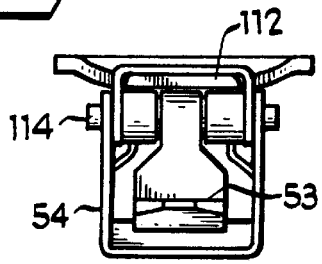
FIG. 18 is a top view of the base plate and housing with a slidable connection therebetween in FIG. 15, in accordance with the present invention.

FIG. 16 is a side view of the security system in FIG. 15 showing a universal adapter comprising the base plate 60 and housing 12 with a slidable (or slip-on) arrangement 106 and snap fitable arrangement 108, preferably in the form of snap-in detents, connectable with the base plate. Optionally, a bolt can help secure the slidable arrangement to the base plate 60, through port 110, for secure and permanent mounting. Preferably, the contour of the base plate substantially matches the inside contour of the lock. This structure provides a secure connection, and keeps the lock from moving up and off the plate 60 while in use and in the mounted position. Additionally, this contour provides a narrow profile, to accommodate the slip-on feature for improved portability. Also shown in FIGS. 16 and 18, is how the base plate 60 extends upwardly through a bracket 112 (also referred to as slip-on member 59) of the lock. This feature helps to substantially minimize any contact between the trailer head and lock. Advantageously, this structure makes contact first, therefore protecting the lock.

In FIG. 18, a top view of the base plate and with a slidable connection is shown, which includes a bracket 112 pivotably connected to the housing 12, by pivot 114, to facilitate installation, connection and disconnection to the housing 12. As best shown in FIG. 18, the slip-on concept is illustrated. This structure shows how easy it is to connect the lock in place without the necessity of tools. For example, an installer can use one hand to position, hook and pivot the lock in place with respect to the base plate 60. This figure also shows the narrow profile for minimal intrusion into the valuable cargo space.

Figure 17:
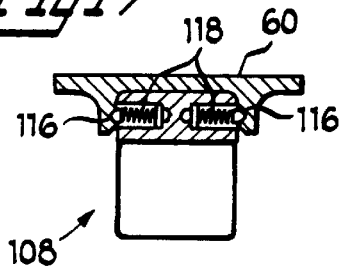
FIG. 17 is a sectional view along line 17—17 in FIG. 15, showing the base plate and housing with a snap fitable arrangement connectable with the base plate, in accordance with the present invention.
Figure 19:
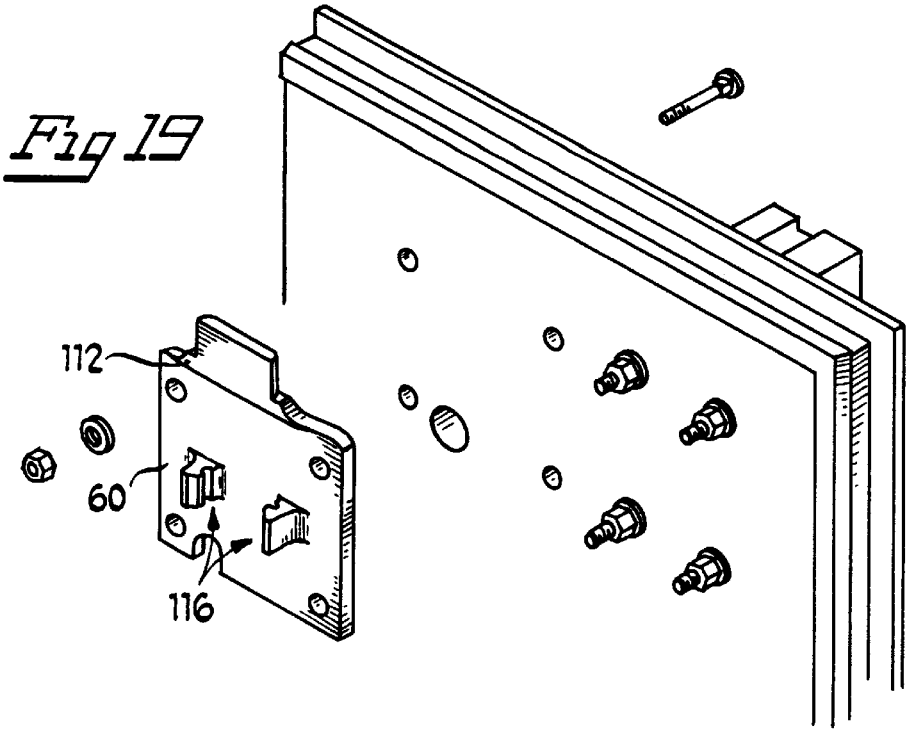
FIG. 19 is an isometric view of the security system in FIG. 1 showing the base plate in FIG. 15, being connectable with a door, in accordance with the present invention.

FIGS. 17 and 19 best show the snap-fitable arrangement 108, which comprises a pair of mirror-imaged outwardly extending fingers 116 each with a channel, and the housing 12 can have horizontally extending spring lock members 118 configured to be received at least partially in the channels, for a secure connection between the housing 12 and base plate 60, and ultimately to a door.

In FIG. 17, the ease of connection is illustrated, by simply snap-fitting in place. In a preferred embodiment, spring detents are adjustable and adapted to fit into the casting and fingers 116. In one embodiment, generally V-shaped pockets of fingers 116 are casted, to provide a simple and cost effective design. This design provides for low tolerance parts, minimal outward extension so as to only minimally extend into the cargo space and a chamfer portion of the fingers 116 is intended to simplify insertion of the lock.

Referring to FIG. 19, an isometric view of the base plate 60 connected to a door is shown. This shows a typical or conventional installation and location of the base plate 60 in normal use. In one embodiment, only four holes for mounting is necessary. Also preferred, is the use of high strength bolts to deter grinding. Also, the use of round type heads can help to make it difficult to grab with vise grips and the like during an attempted break in. Also shown, is a hole or opening to allow a key through for locking and unlocking, in the integrated lock embodiment, as detailed herein.

Figure 20:
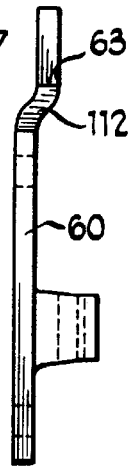
FIG. 20 is a side view of the base plate in FIG. 19, in accordance with the present invention.
Figure 21:
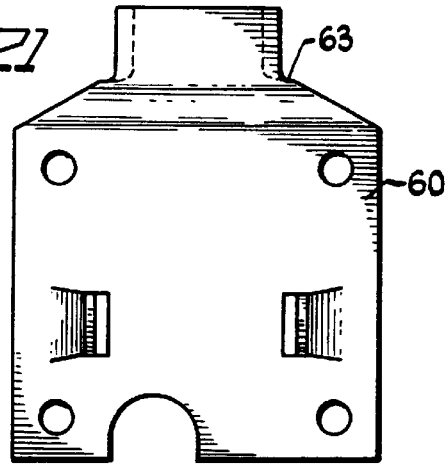
FIG. 21 is a front view of the base plate in FIG. 19, in accordance with the present invention.
Figure 22:
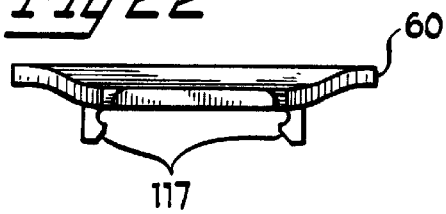
FIG. 22 is a rear view of the base plate in FIG. 19, in accordance with the present invention.
Figure 23:
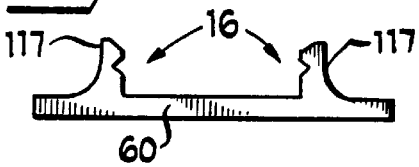
FIG. 23 is a bottom view of the base plate in FIG. 19, in accordance with the present invention.

Additionally, holes for bolts and a bottom opening for a key can be included, as shown in FIGS. 20–23, for example. In FIG. 20, the simple construction and narrow profile of the base plate 60 is shown. The upper portion shows a preferred contour to allow and facilitate slip on connection of the lock thereto. FIG. 21 shows a generally front view of the plate 60, and illustrates the portability or minimal real estate required. It also shows holes and opening/access for key, as detailed above. Also shown, is an upper portion of the base plate 60 defining a ledge 63 (in FIG. 21) for secure placement and alignment of the lock 11 with respect to the base plate 60. FIG. 22 is a top view of the base plate 60 and shows the contour of the plate 60 in proximity to the fingers 116, for guiding the lock into a pocket (or recepticle) adapted to receive the lock and for providing a tight and secure connection and fit thereto. In a preferred embodiment, this figure shows a low profile and built in groove for receiving a spring loaded snap on member 57, for example. In FIG. 23, the outer and inner portions define chamfers 117 of the fingers 116. They can be at an angle to help provide a guide when connecting a lock with the plate 60, and preferably the angle is at about 45 degrees with respect to the plate 60, for improved steering and guiding of the lock into the pocket (which is defined by the area substantially between the fingers).

Figure 2:
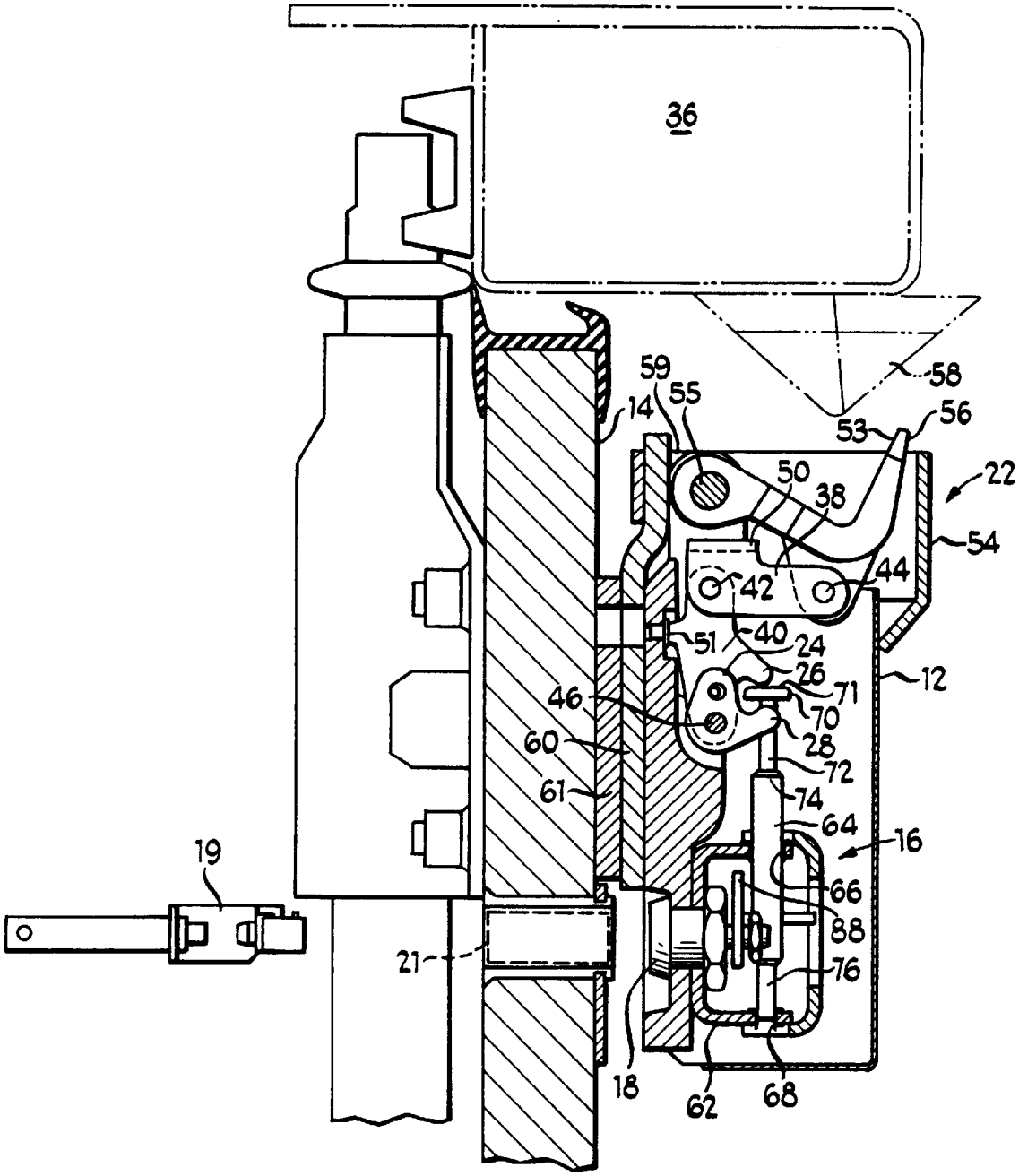
FIG. 2 is a side, cut-away view of another embodiment of a security system for cargo loading doors showing a lock housing with an internal key receptacle, in accordance with the present invention.

The housing 10 can be slip fit and snap connected in place, to a base plate 60 on the door, in one embodiment. Also in one embodiment, a shock pad 61 can be provided, to help minimize shock and vibration to housing 10 and the associated components in FIG. 2. Also shown in FIG. 2, is a slip on member 59 and spring loaded plunger 57, for facilitating connection and installation of the system 10. And, a bumper 51 is shown on the linkage mechanism 32, so as to minimize the possibility of the linkage mechanism 32 from locking up and softening the impact between the linkage mechanism 32 and housing 12, when moved to the unlocked position. The key receptacle (actuator) 18 can be a high security tubular lock, such as Part No. 1058 or the like available from Fort Lock, Inc. in River Groove, Ill. Likewise, the push-pull cable 48 can be a solid core control cable known to those skilled in the art, with a stainless steel core, such as Part No. CC-5210XX, available from Cable Manufacturing and Associates, Inc. in Rockaway, N.J.

The system 10 can be retrofitted or factory installed, thus minimizing the need for cutting, drilling or welding during installation.

The proximal or distal sections 40 and 38 includes a stopper mechanism 50 for aligning the linkage mechanism 32 to provide a substantially rigid link when the latch structure 30 is in the locked position 20, the stopper mechanism 50 aligns the proximal section 40 with the distal section 38 slightly beyond center (shown in dashed line in FIG. 9) 52 from a straight line, defining a slight angle of about 15 degrees or less from a straight line and providing a simulated rigid link.

Figure 9:
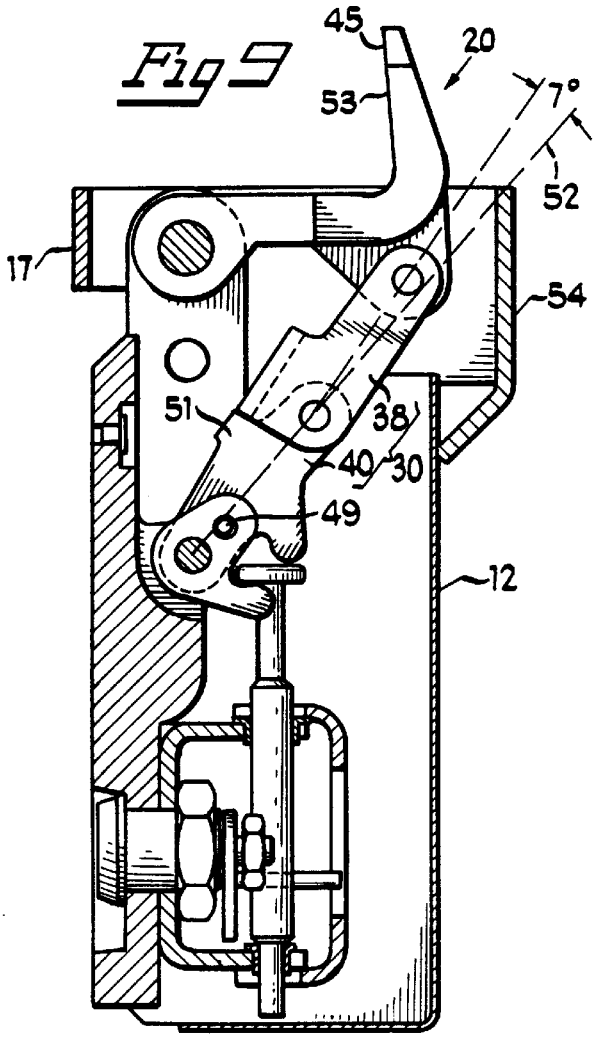
FIG. 9 is a sectional view of the security system for cargo loading doors in FIG. 8, along lines 9—9, showing the lock housing with an internal key receptacle in a locked position
Figure 11:
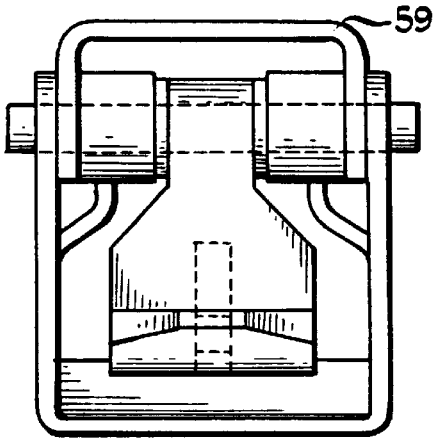
FIG. 11 is a top view of the security system for cargo loading doors in FIG. 8, in accordance with the present invention.

In one embodiment, the angle ranges from about 10 degrees to about 5 degrees from a straight line, as shown for example in FIG. 9, and most preferably about 7 degrees, for an improved rigid link. A simulated rigid and off-center link is an improvement over a straight line link in that it has enhanced tamper resistant qualities, and helps to ensure isolation of forces through the housing. Advantageously, this structure helps transfer forces from the L-shaped member 54 to the housing 12 during tampering, while also providing the appropriate functionality, as detailed herein.

As shown in FIG. 9, the L-shaped member 54 has an inner surface 53 configured at a predetermined angle to form a vertical axis. In one embodiment, the angle ranges from about 15 degrees or less from a vertical axis, as shown for example in FIG. 9, and more preferably about 5 degrees, for an improved self engaging angle with a complementarily configured receptacle 58, as shown in FIG. 2, for enhanced tamper resistant qualities.

Figure 8:
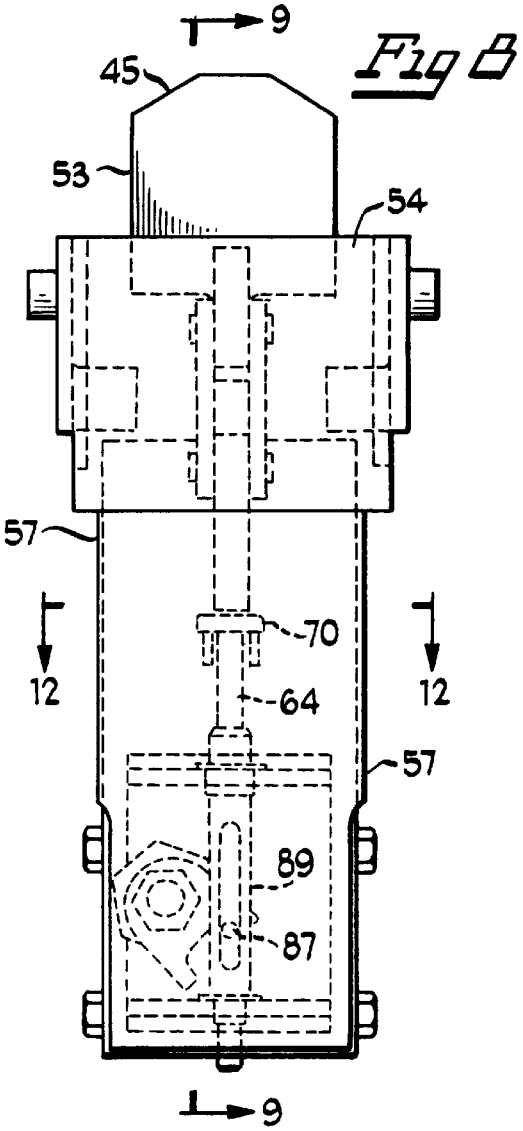
FIG. 8 is a front view of the security system for cargo loading doors in FIG. 2, showing the lock housing with an internal key receptacle, in accordance with the present invention.

As shown in FIG. 2, the latch structure 30 can include a generally L-shaped member 54 with an end portion 56 couplable with a complementarily configured receptacle 58 for receiving the end portion 56 in a portion of a header of a container, to provide a secure lock and minimize and slow down break-ins. As should be understood, the L-shaped member 54 and receptacle 58 can have various geometry's, to accommodate various containers, depending on the application. Advantageously, this structure provides a self-engaging angle for improved locking, when in the locked position. In a preferred embodiment, this structure is made of a strong and light weight material, for ease of movement and strength, such as steel, certain polymers and composites and the like, for example. Also, the end portion 56 of the L-shaped member 54 has angled portions, to allow some movement thereof, to provide a floating door to minimize the possibility of the door and lock from binding up. Additionally, as shown in FIGS. 8 and 9, the L-shaped member 54 has a chamfered, contoured portion 45 for added engagement and length, with minimal additional weight.

Figure 12:
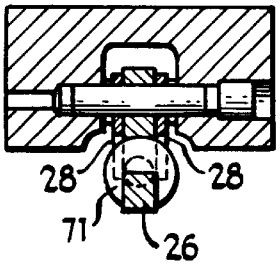
FIG. 12 is a sectional view of the security system for cargo loading doors in FIG. 8, along lines 12—12, showing part of a C-shaped member and plunger assembly, in accordance with the present invention.

Also shown in FIG. 2, the plunger assembly 34 can include an anchor frame 62 connected to the housing 12, and elongated plunger 64 slidably connected thereto. In one embodiment, the plunger assembly 34 includes an anchor frame 62 having ports 66 and 68 and a plunger 64 slidably connected thereto, the plunger 64 including a head 70, neck 72, body 74 and bottom 76, the body 74 and bottom 76 being configured to be received in the ports 66 and 68 of the anchor frame 62, respectively. This structure provides a simplified construction and contributes to the narrow profile of the housing 12, thus contributing to maximizing usage of the valuable cargo space in a container. In FIGS. 2 and 12, the head 70 is shown terminating with a large diameter, flat section 71, to provide a sufficient contact area with the C-shaped member 24 of the linkage mechanism 32. In a preferred embodiment, a spring 43 is coupled to the plunger 64, to push the plunger 64 downwardly, to stabilize the plunger 64 during transit (ie. vibration) and provide resistance when unlocking. In one embodiment, the key receptacle 18 could replaced with an electronic actuator, such as a solenoid and rf receiver, to open and close, with a wireless transmitter, for example.

Figure 14:
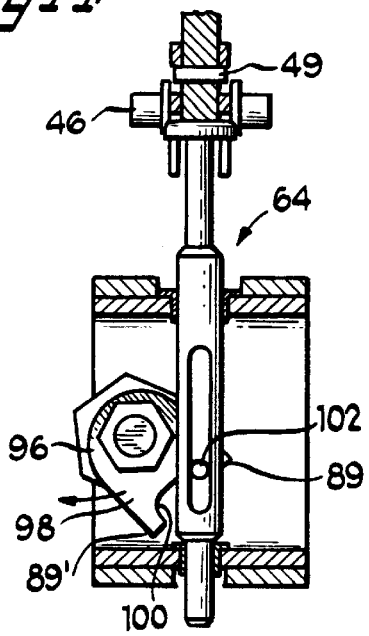
FIG. 14 is a partial view of the security system in FIG. 2 showing a partial, front view of an internal portion of the lock housing with an internal key receptacle, when in a locked position, in accordance with the present invention.

In one embodiment, as shown in FIG. 2, the proximal section 40 of the linkage 32 includes a C-shaped member (or cam assembly) 24 substantially complementarily configured to receive the head 70 of the plunger 64. In a preferred embodiment, the cam assembly 24 includes at least one top finger (or first member) 26 and two bottom fingers (or second members) 28, the head 70 is received substantially between the top 26 and bottom fingers 28 in a vertical direction in FIG. 2, and the neck 72 of the plunger 64 is received between the two bottom fingers 84 in a horizontal direction in FIG. 8. A pressed finger 49, shown in FIGS. 9 and 14, can be used to assemble the C-shaped member 24, thus providing a robust and inexpensive structure.

Advantageously, this structure provides a robust construction for improved movement of the latch structure 30 and linkage mechanism 32, in the harsh environments and temperature variations it will be exposed to.

In more detail, the C-shaped member 24 provides the following advantages. It helps to substantially isolate and minimize shock to the latch structure 30 and linkage mechanism 32, to the plunger 64 and associated structure from loads and forces during transportation (ie. vibrations) and attempted break-ins. It also provides for use of a low tolerance part or interface for the plunger 64 and linkage mechanism 32, for example, which can be assembled and manufactured easily and inexpensively.

Figure 5:
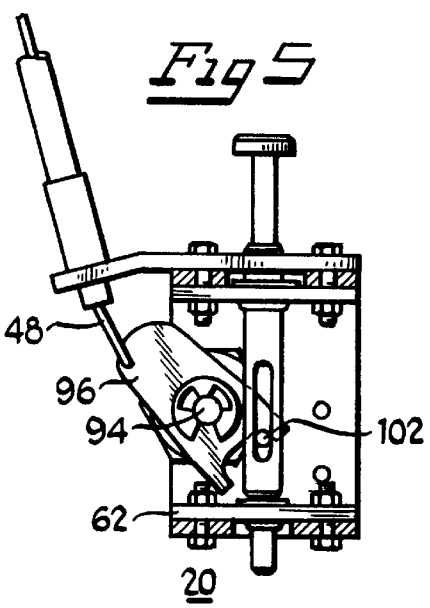
FIG. 5 is a partial view of the security system in FIG. 1 showing a partial, front view of an internal portion of the housing when in a locked position, in accordance with the present invention.
Figure 4:
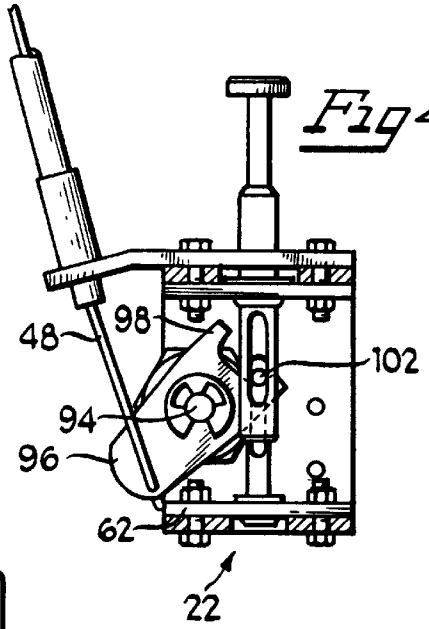
FIG. 4 is a partial view of the security system in FIG. 1 showing a partial, front view of an internal portion of the housing when in an unlocked position, in accordance with the present invention.
Figure 3:
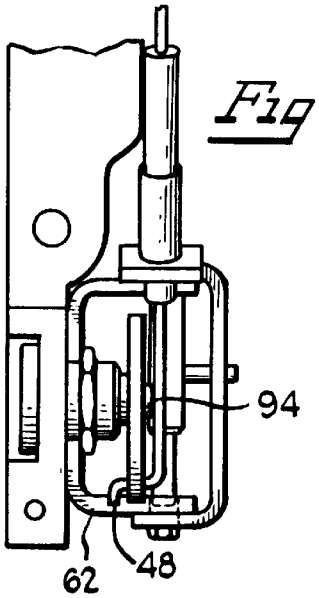
FIG. 3 is a partial view of the security system in FIG. 1 showing a partial, side view of the lock housing with many components therein, in accordance with the present invention.

In one application, the actuator 16 can be connected to the housing 12 via a cable assembly 86 in one embodiment as shown in FIG. 1, or it can be substantially located in the housing 12 in another, as shown in FIG. 2. In FIG. 3, a partial view of the lock assembly in FIG. 1 showing a side view of a remote key receptacle housing 90 is shown, with many of the components therein. FIG. 4 shows the system 10 in an unlocked position and FIG. 5 show when in a locked position. In FIGS. 3–5, the lock housing 12 can include an arm 92 pivotably connected to the anchor frame 62 via a stationary pivot pin 102, the arm 92 has a first end 96 and a second end 98, which generally defines a generally C-shaped cam member 88 pivotably connected to the housing 12, and couplable with the plunger 64 via pin 102.

Figure 7:
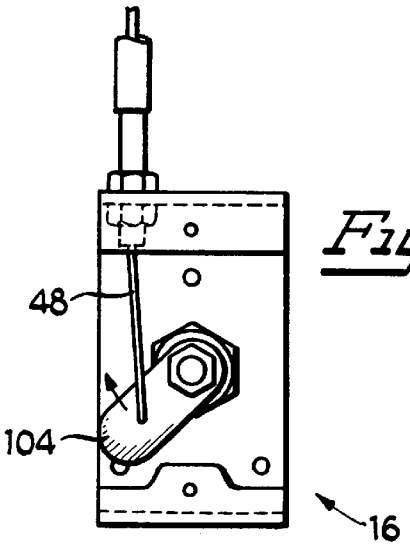
FIG. 7 is a partial view of the lock assembly in FIG. 1 showing a partial, side view of the remote key receptacle, in accordance with the present invention.
Figure 6:
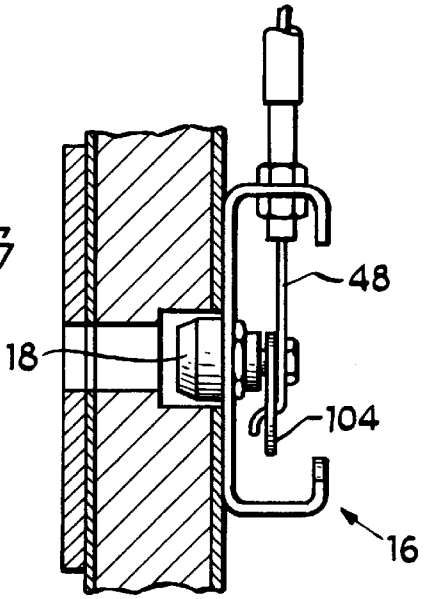
FIG. 6 is a partial view of the security system in FIG. 1 showing a partial, top view of the remote key receptacle, in accordance with the present invention.

In more detail, FIGS. 1 and 3–5 show the lock housing 12 (with a remote key receptacle housing 90 (in FIGS. 6 and 7). In this embodiment, the cable 48 can provide the necessary force to move the system 10 to and from the open and closed positions, as appropriate, when a key 19 is inserted into the key receptacle 18, in the remote housing 90 in FIG. 6, for example. In a preferred embodiment, the cable 48 and/or cable assembly 86, is enclosed in conduit, for enhanced protection thereof. The conduit can have an S-like pattern to minimize contamination and catching of dirt, dust and the like, and when knocked or cut-off, will pivot to a side to make it difficult to tamper with.

Likewise, in FIGS. 6 and 7 a remote key receptacle housing 90 is shown, with another arm 104 connected to a key receptacle 18, for opening and closing the system 10. This embodiment allows for easy access to the key receptacle 18 for a user, and can be appropriately positioned near a bottom of a door, and preferably adjacent to and behind a hinge of a door, for improved strength and a hidden view (camouflaged), as shown in FIGS. 2 and 10. The receptacle can include a bolt like means or plug 21 insertable in the key receptacle 18, to cover and hide the receptacle 18, to hide it from an opportunist.

The housing 12 is strategically positioned inside of and adjacent to a cargo loading door 14 such that it is substantially free from interfering with a loading and unloading operation. The placement shown in the figures is preferred so as to minimize the possibility of damage during loading and unloading of the cargo.

As best shown in FIGS. 2 and 9, detailed below is a simplified description of how the security system can be used. A key 19 is inserted through a cargo loading door 14 and key receptacle 18. The key receptacle 18 is attached to a C-shaped member (cam assembly) 88, as shown in FIGS. 2, 8 and 9. The C-shaped member 88 is rotated clockwise, as viewed in FIGS. 8 and 14 (arrow). As shown in FIG. 8, an upper member 89 catches and contacts a cross-pin 87. The cross-pin 87 is thus moved downward. The cross-pin 87 is connected to a plunger 64. The plunger 64 slides downwardly, due in part to the cross-pin 87 being connected to the plunger 64. In a preferred embodiment, the cross-pin 87 is encapsulated in a slot, thus the plunger 64 does not rotate, during movement. Next, a head 70 of the plunger 64 makes contact with fingers 28 of the C-shaped member 24. The C-shaped member 24 rotates about a stationary pivot 42, and makes contact with a pin 49 affixed to a proximal section 40 of the linkage assembly 32. The proximal section 40 then rotates with the C-shaped member 24 about the same pivot 46. The distal section 38 moves outward and due to the connection between the proximal section 40, and thus the linkage mechanism 32 articulates to a slight angle, as shown in FIG. 9, (in dashed line shows an inner surface 53 at an angle of about five degrees from a vertical axis). Thus, the L-shaped member 54 pivots about the housing 12 and rotates upward to a locked position.

Figure 13:
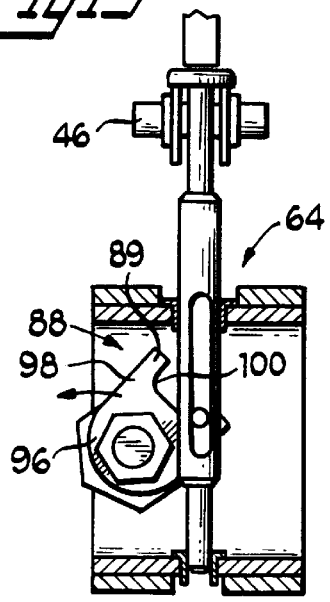
FIG. 13 is a partial view of the security system in FIG. 2 showing a partial, front view of an internal portion of the lock housing with an internal key receptacle, when in an unlocked position, in accordance with the present invention.

Referring to FIG. 2, detailed below is a simplified description of how the security system can be used and moved to an unlocked position. A key 19 is inserted through a door 14 and key receptacle 18. The C-shaped member 88 is rotated counter clockwise, as shown in FIG. 13 (arrow). In FIG. 13, a second lower member 89' catches and contacts the cross-pin 102. The cross-pin 102 is moved in an upward direction. The cross-pin 102 is connected to a plunger 64. The plunger 64 slides upwardly, because it is connected to the plunger 64. Next, the flat portion 71 of the head makes contact with the first member 26 of the proximal section 40. In FIG. 2, the proximal section 40 pivots about the stationary pin rotating clockwise. The proximal section pivots until making contact with a (backstop) bumper 51. The distal section 38 then drops and rotates downward. Since it is connected to the L-shaped member 54, it pivots about stationary pivot pin 55 in FIG. 2, and housing 12 and rotates downward to the unlocked position.

Referring to FIGS. 1 and 3–7, detailed below is a simplified description of how the security system can be used and moved to an unlocked position, with a remote actuators 16. A key 19 is inserted through a door and remote key receptacle 18. The key receptacle 18 is attached to an arm 104, in FIG. 6. The arm 104 in FIG. 6 is rotated clockwise (arrow in figure). The arm 104 is connected to the cable 48, which can be moved up or down. The cable 48 at the other end is connected the C-shaped member 88, in FIGS. 3–5. The C-shaped member 88 pivots about the (spindle) pin 102, which is rotated counter clockwise, to move to the unlocked position. The remaining steps are substantially similar, as detailed above.

Figure 25:
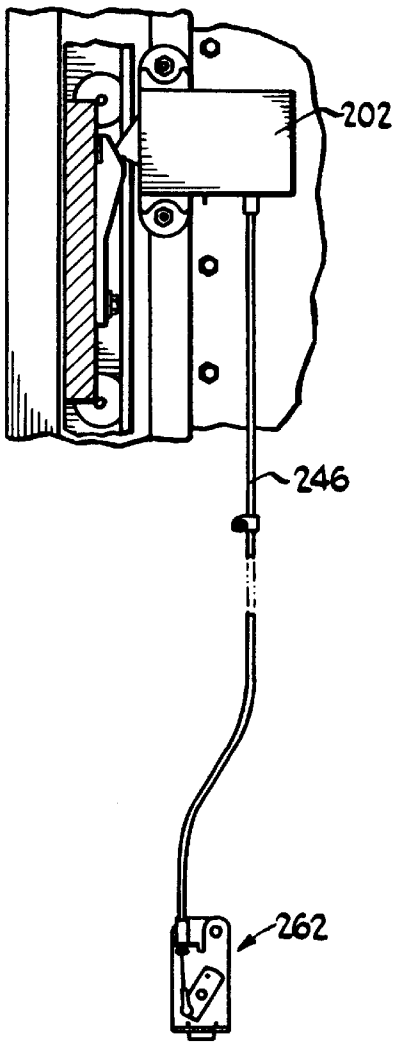
FIG. 25 is a slightly more detailed and simplified drawing of the security system for roll-down loading doors in FIG. 24, showing the lock housing with a remote key receptacle coupled with a push-pull cable, in accordance with the present invention.
Figure 24:
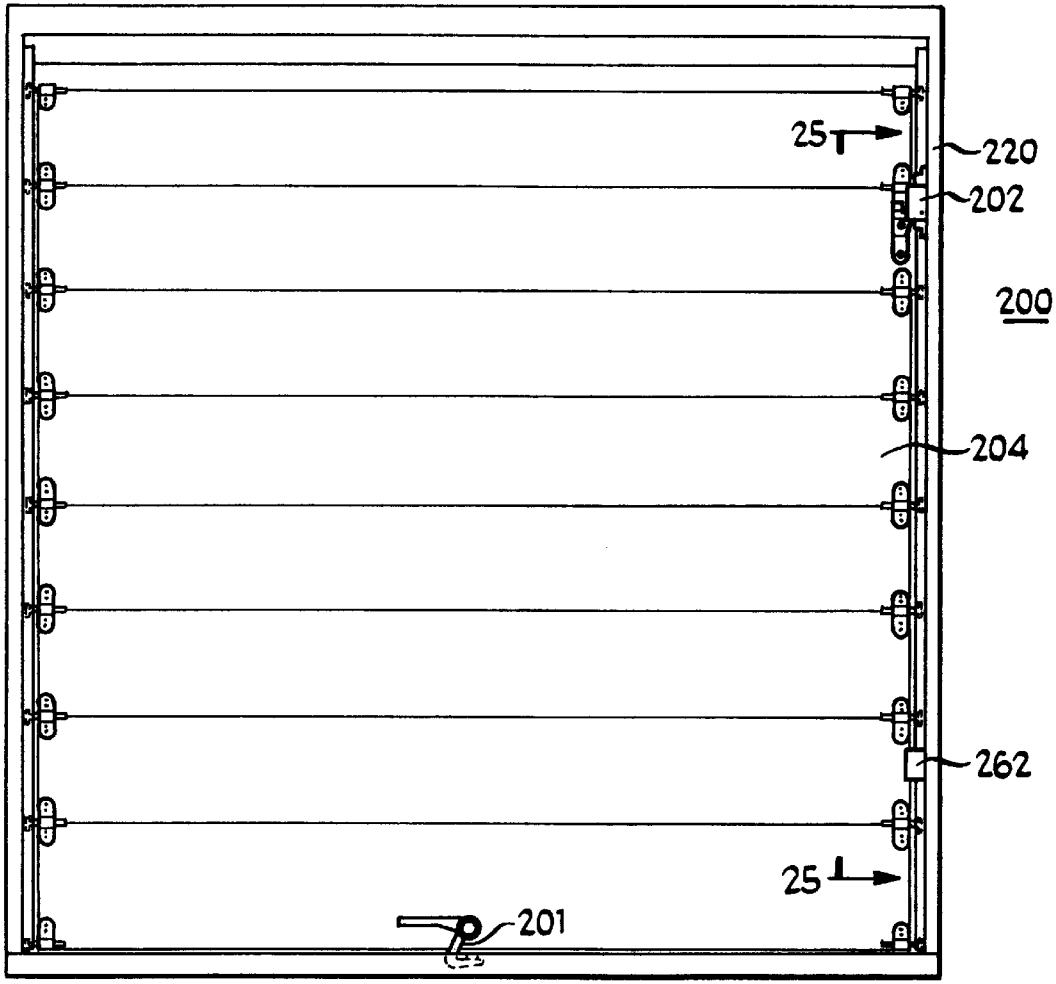
FIG. 24 is a planar, view from inside a container, trailer or other similar enclosed body, showing an embodiment of a security system for roll-down loading doors, showing an exemplary placement of a lock housing with a remote key receptacle coupled with a push-pull cable, in accordance with the present invention.

Referring to FIG. 24, a view from inside a container, trailer or other similar enclosed body, is illustrated, showing a security system for roll-down loading doors 200, with an exemplary placement of a lock housing with a remote key receptacle coupled with a push-pull cable. This embodiment provides a high "out of the way" location for the lock, low easily accessable key location and low profile design (minimal intrusion into the cargo space). In use, a door 204 with a J-hook 201 is typically placed in a closed, locked, latched or pulled-down position, before the lock is triggered to the locked position. In FIG. 25, a lock housing 202, remote actuator 262 and cable assembly 246 is shown.

Figure 29:
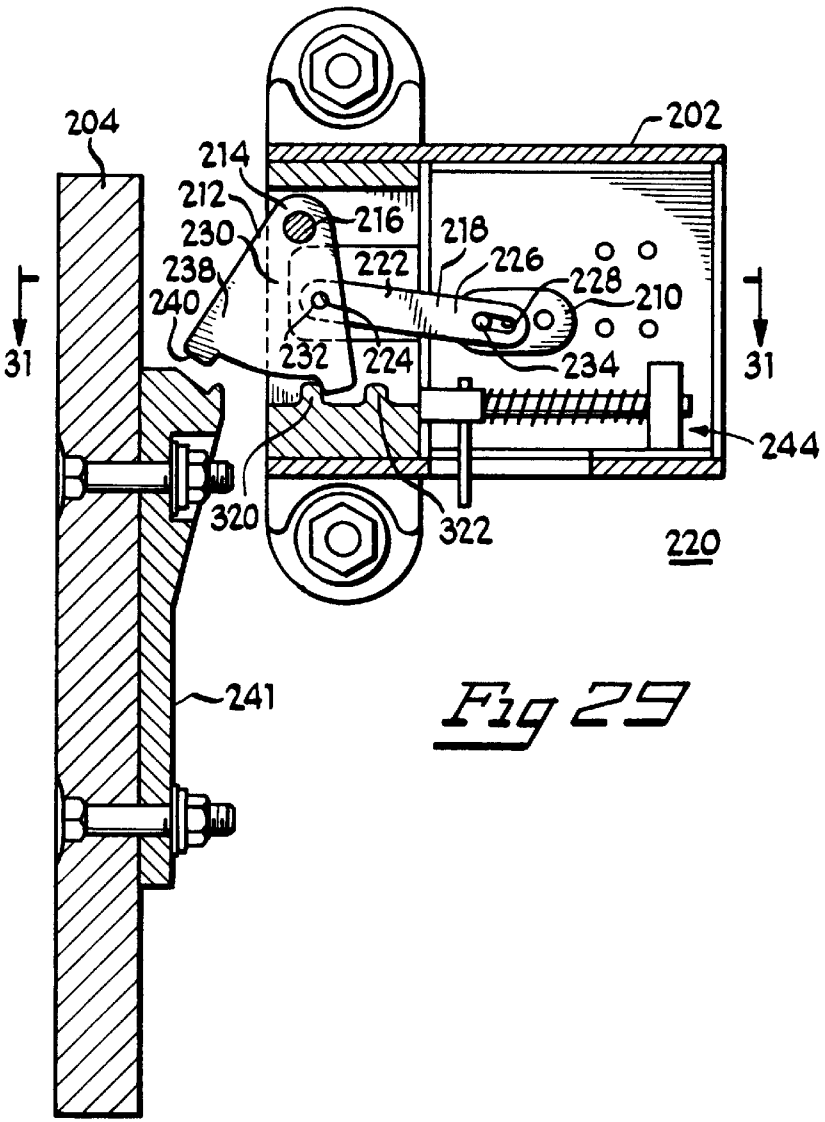
FIG. 29 is a sectional view of the security system for roll-down loading doors along lines 29—29 in FIG. 28, showing some of the internal components of the lock housing, adapter and receptacle, in a locked position, in accordance with the present invention.
Figure 31:
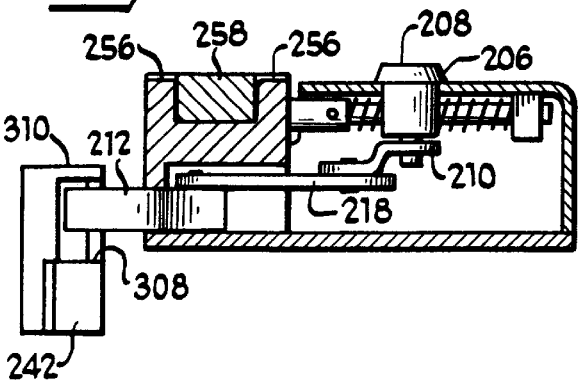
FIG. 31 is a sectional view of the security system for roll-down loading doors along lines 31—31 in FIG. 29, showing some of the internal components of the lock housing, linkage and actuator, in accordance with the present invention.

As best shown in FIGS. 24, 29 and 31, a security system (also referred to as "lock") 200 of the invention, can comprise: a substantially narrow profile lock housing 202 adapted to being connected to a door of a cargo carrying enclosure; an actuator 206 having a key receptacle 208 including a pivotable arm 210, for moving a latch structure between a locked position and an unlocked position; the latch structure 212 can generally be triangular in shape, with a top portion 214 being hingably connected to the housing 202 with a stationary pivot pin 216 and the actuator 206 being coupled by a linkage mechanism 218, the latch structure 212 is adapted to be connected to a loading door 204 of a cargo carrying enclosure when the latch structure 212 is in the locked position and withdrawn from the door 204 when the latch structure is in the unlocked position; and the linkage mechanism 218 can include a distal section 222 having a port 224 and a proximal section 226 having a second port 228, the distal section 222 is coupled to a middle portion 230 of the latch structure 212 with a first pivot pin 232 and the proximal section 226 is coupled with the pivotable arm 210 with a second pivot pin 234, the linkage mechanism 218 and pivotable arm 210 define a substantially rigid link provided by the linkage mechanism 218 and pivotable arm 210 being substantially aligned when the latch structure 212 is in the locked position and the linkage mechanism 218 and pivotable arm 210 being substantially perpendicular when the latch structure 212 is in the unlocked position. Advantageously, this provides a low-profile, reliable security system. Additionally, the lock 200 can be easily installed or removed and subsequently, put back into service on another, different trailer, if desired.

As should be understood by those skilled in the art, the lock housing can be attached to either a wall or door, depending on the application.

Figure 32:
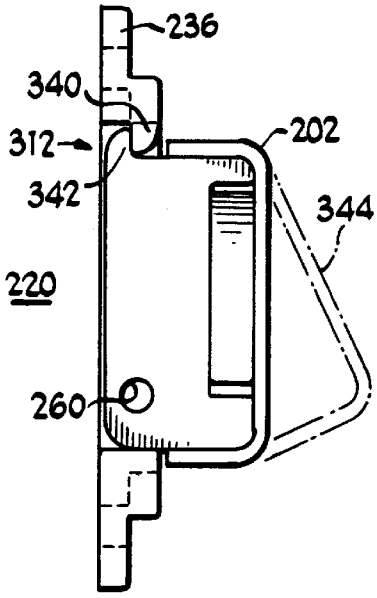
FIG. 32 is a simplified, sectional view of the security system for roll-down loading doors along lines 32—32 in FIG. 30, showing in one embodiment how the lock housing and adapter are complementarily configured to interconnect with each other, in accordance with the present invention.

In a preferred embodiment as best shown in FIG. 32, the housing 202 includes a base plate 236 which is substantially complementarily configured to interconnect and at least partially receive a portion of the housing 202. This structure provides a quick connect feature or "hook and grab feature" 312, to facilitate connection and disconnection to a wall 220. Additionally, it provides a narrow profile to minimize intrusion into the valuable cargo space. During installation, an upper and inner portion of the housing 212 is inserted and pivoted inwardly and downwardly to the base plate 236. Also during this process, the spring lock assembly 244 is moved to a a retracted position, as shown in FIG. 34, and thereafter after in place, released and move to an extended and locked position, as shown in FIG. 33.

Figure 30:
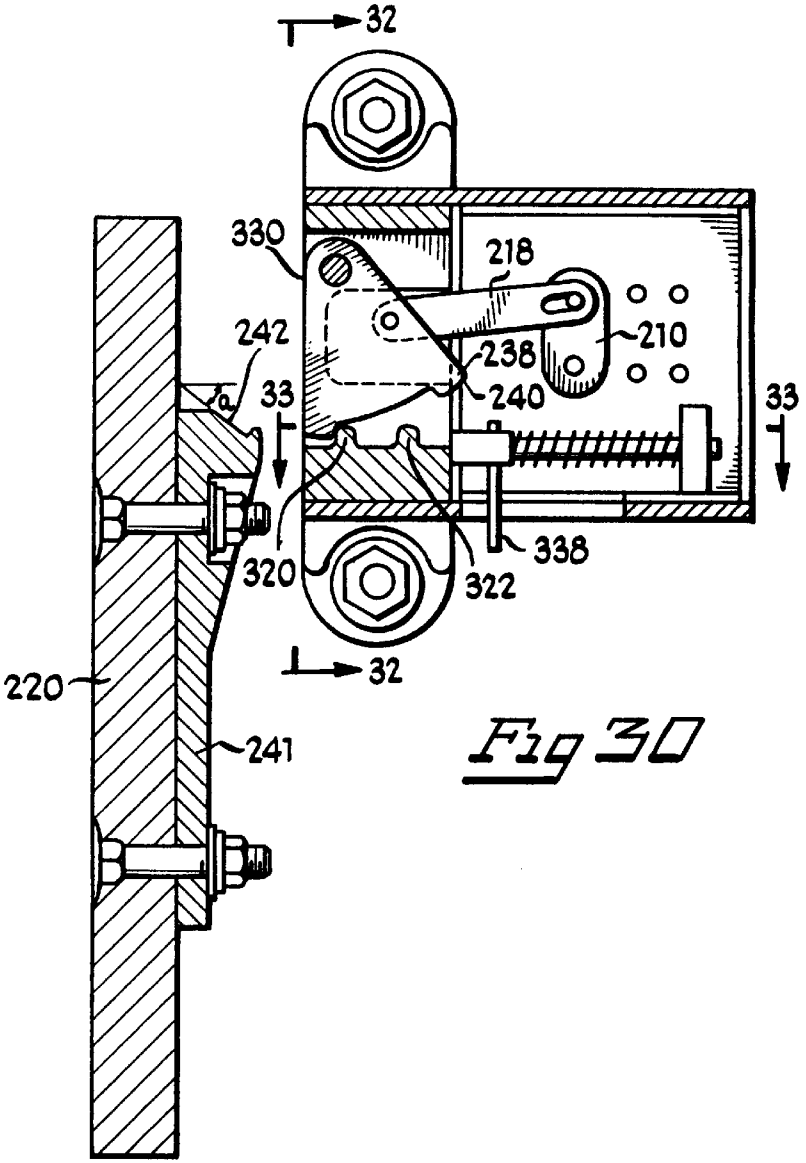
FIG. 30 is a sectional view of the security system for roll-down loading doors along lines 29—29 in FIG. 28, showing some of the internal components of the lock housing, adapter and receptacle, in unlocked position, in accordance with the present invention.
Figure 33:
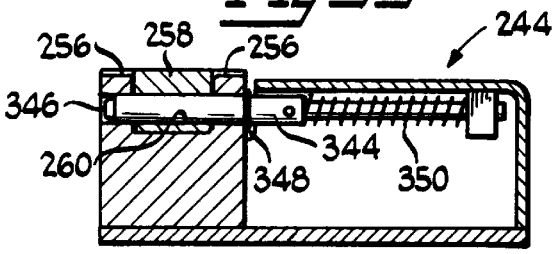
FIG. 33 is a simplified, sectional view of the security system for roll-down loading doors along lines 33—33 in FIG. 30, showing in one embodiment a quick connect feature comprising a spring loaded dead-bolt and hole, in a connected condition, in accordance with the present invention.
Figure 34:
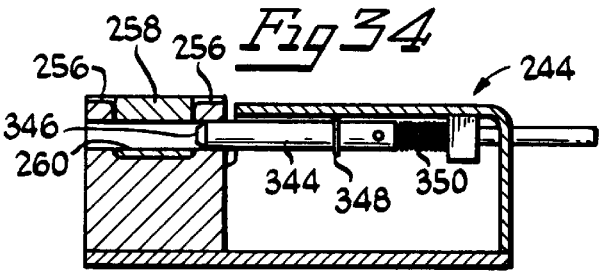
FIG. 34 is a simplified, sectional view of the security system for roll-down loading doors along lines 33—33 in FIG. 30, showing in one embodiment a quick connect feature comprising a spring loaded dead-bolt and hole, in an unconnected condition, in accordance with the present invention.

FIGS. 33 and 34 are simplified, sectional views of the security system for roll-down loading doors along lines 33—33 in FIG. 30, showing in one embodiment a quick connect feature comprising a spring loaded dead-bolt and hole, in a connected and unconnected condition, respectively. More specifically, in FIG. 33, two fingers 256 of the lock housing 202 mate with a portion 258 of the base plate 236. The spring lock assembly 244 securely connects the lock housing 202 to the base plate 236, by extension of the dead bolt means in and through a receptacle hole 260. This structure provides a simple means of connecting the housing 202 to a wall 220, for example.

Figure 27:
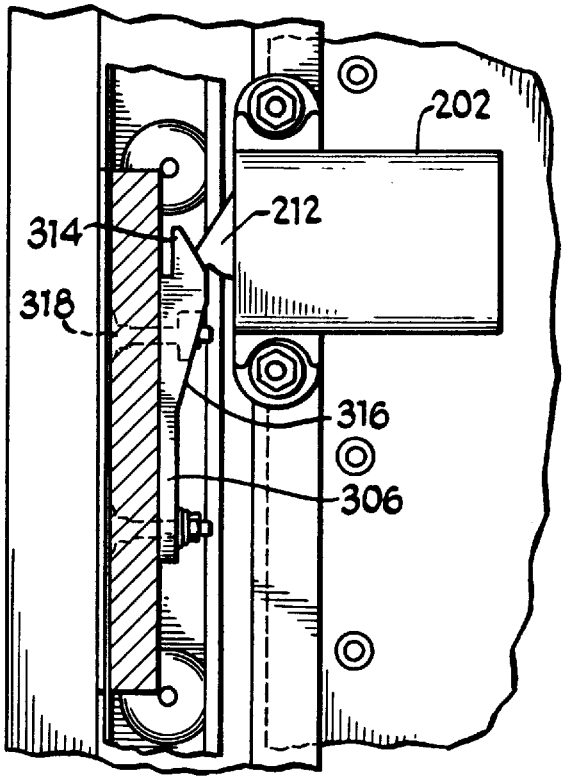
FIG. 27 is a simplified partial view of the security system for roll-down loading doors in FIG. 26, showing a front view of a lock housing, adapter and receptacle, in accordance with the present invention.
Figure 28:
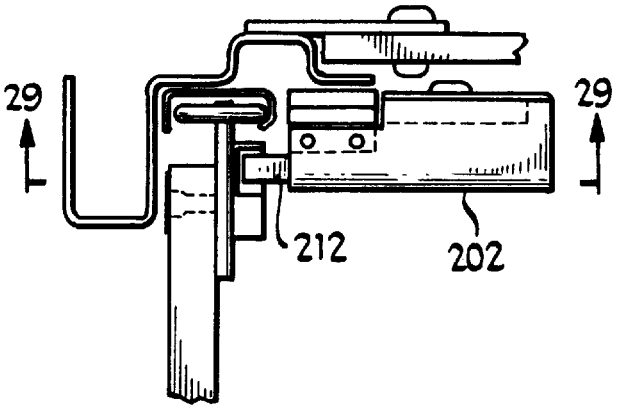
FIG. 28 is a simplified partial view of the security system for roll-down loading doors in FIG. 26, showing a top view of the lock housing, adapter and receptacle, in accordance with the present invention.

As shown in FIGS. 25, 27 and 28, the latch structure 212 includes at least one generally downwardly extending member 238 with an end portion 240 couplable with an adapter block 241 with a substantially complementarily configured receptacle 242 for receiving the end portion 240 in or in proximity to a portion of a door 204 of a container, to provide a self-engaging angle, as shown by item a in FIG. 30, which can vary, and preferably ranges from about 35 degrees to about 45 degrees with respect to a horizontal axis, and most preferably about 38 degrees, for providing an improved locking structure. This angle directs a force through pin 216, for improved integrity of the lock.

As shown in FIGS. 33 and 34, the housing 202 includes a spring lock assembly 244 to facilitate connection and/or disconnection to and from the base 236. More particularly, the housing 202 can include a spring lock assembly 244 including a retracted position in FIG. 34, to facilitate disconnection from the base 236 and an extended position in FIG. 33, for facilitating connection to the base 236.

Figure 36:
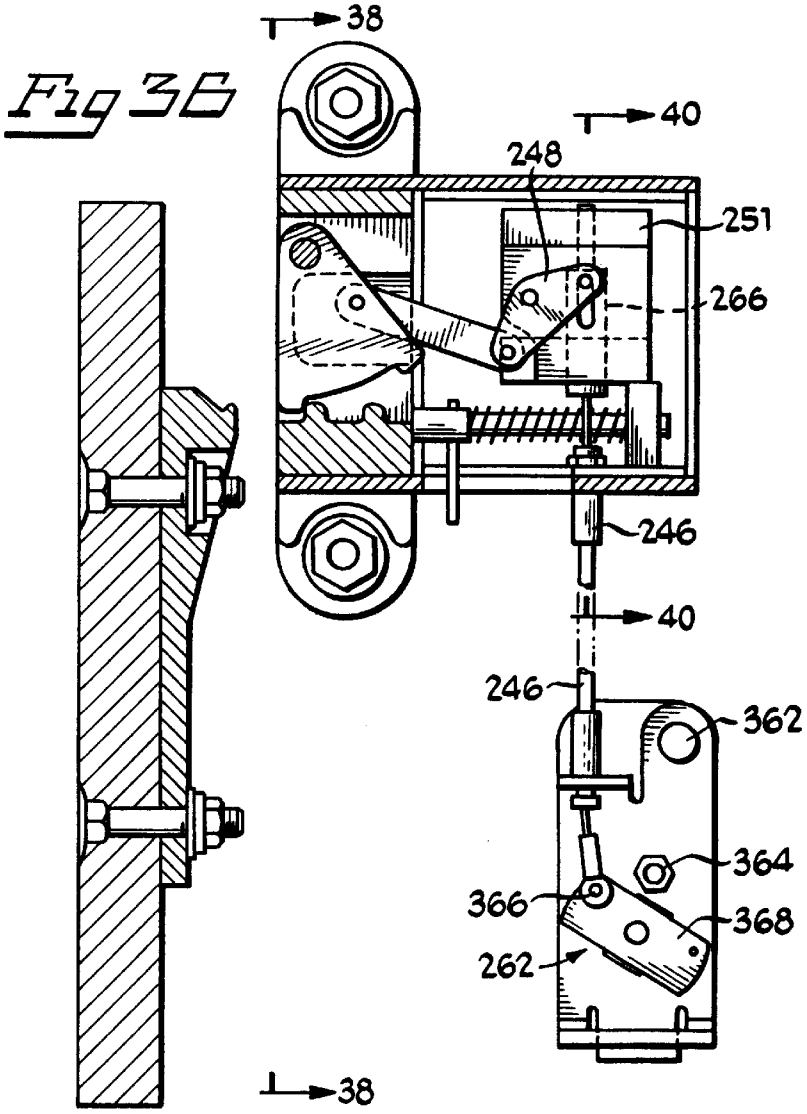
FIG. 36 is a sectional view of an embodiment of the security system for roll-down loading doors with a remote actuator along lines 29—29 in FIG. 28, showing some of the internal components of the lock housing, adapter and receptacle and remote actuator, in an unlocked position, in accordance with the present invention.
Figure 35:
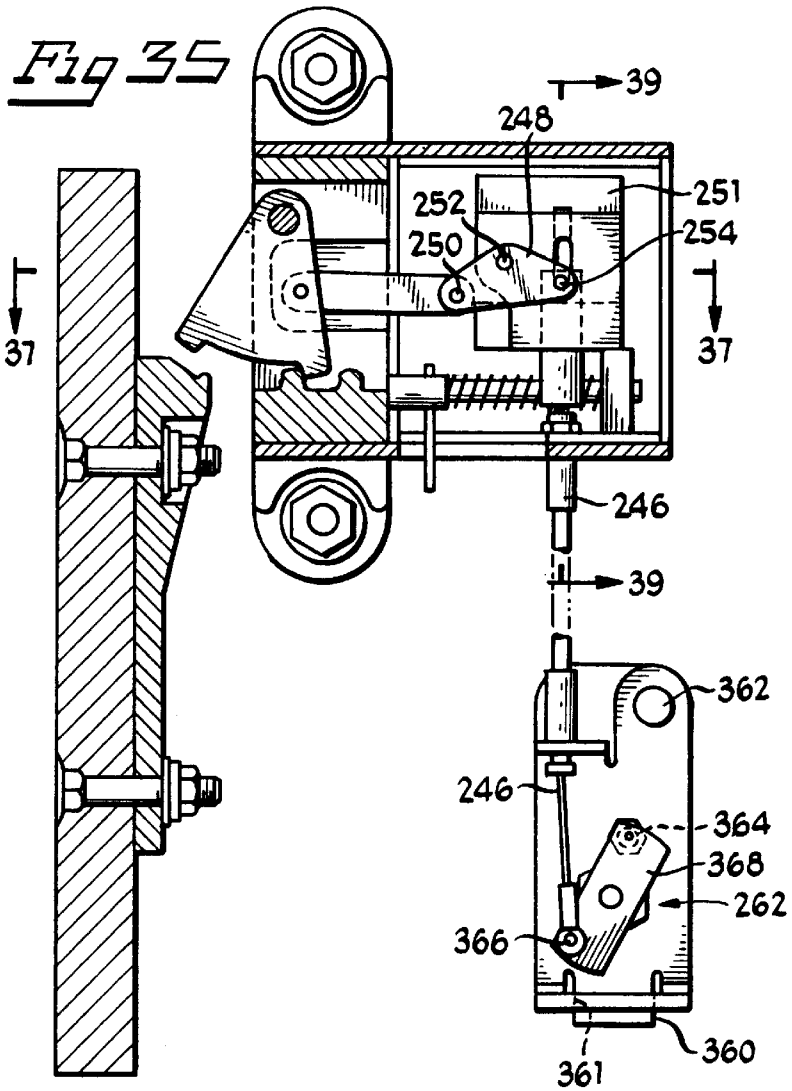
FIG. 35 is a sectional view of an embodiment of the security system for roll-down loading doors with a remote actuator along lines 29—29 in FIG. 28, showing some of the internal components of the lock housing, adapter and receptacle and remote actuator, in a locked position, in accordance with the present invention.

The security system 200 can include an actuator 262 which is connectable to the housing 202 via a cable assembly 246 defining a "remote actuator", and in this embodiment, the linkage mechanism 218 includes a substantially triangularly-shaped mechanism 248, as shown in FIG. 35 and 36, having a first pivot pin 250 connected to the linkage mechanism 218, a second-middle pivot pin 252 connected to an intermediate frame 251 of the housing 202 and allowing pivotable movement thereof and a third pivot pin 254 connected to plunger assembly 266. This provides a more easily accessible actuator, since it can be placed near a lower portion of a wall 220, in a preferred embodiment.

Alternatively, the actuator 206 can be integrated or located in the housing 202, as best shown in the embodiment shown in FIGS. 26–30.

Figure 26:
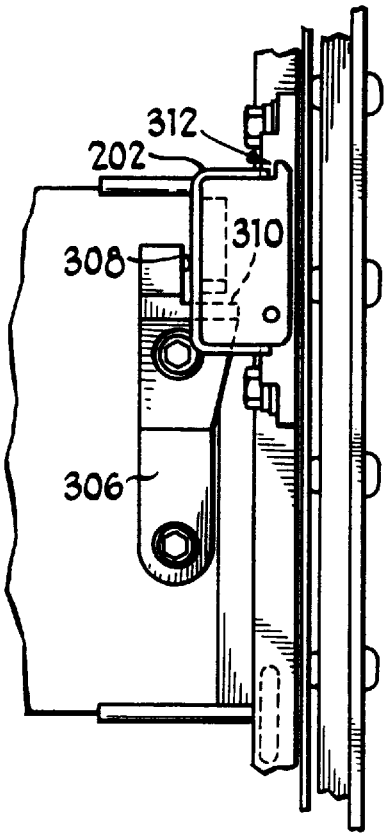
FIG. 26 is a simplified partial view of an embodiment of the security system for roll-down loading doors, showing a side view of a lock housing, adapter and receptacle, in accordance with the present invention.

In FIG. 26, a narrow profile lock housing 202 is shown with an adapter 306 connected to a door. A surface 308 of the adapter 306 keeps the door from moving side to side to the left when locked. Likewise, a lip 310 keeps the door from moving side to side to the right when locked. And finally, a hook and grab feature provides for simplified "fit-up" and connection.

FIG. 27 generally shows how the latch structure 212 connects to the adapter 306. The adapter 306 is shown with an inclined top 314 and bottom 316, to deflect any product in the cargo space away from the latch 212. The inclined portion can push the door up while opening, when the cargo has shifted during transit for example. Flush bolts 318 are shown to clear external frame.

In FIG. 28, the narrow profile lock housing 202 is shown. A loose fit is shown for universal adaption to many trailer styles and allows the door to float.

In FIG. 29, a sectional view of a preferred lock housing 202 is shown, having a latch structure 212 with two downwardly extending members 238 with ends 240, a first for providing a self-engagable connection with the adapter block 241 receptacle 242 and a second to provide a predetermined stop for the latch structure 212 from swinging out beyond a predetermined position. Also shown in this embodiment, is the linkage mechanism 218 with a second port 228 being substantially oblong, to allow for a simplified and low cost design to provide a take-up for extra travel of the lock, as necessary. The latch structure 212 is made of a light weight material for ease of movement and is sufficiently durable. It can be easily pivoted or swung into and out of the locked and unlocked positions. The linkage mechanism 218 provides a simple one link design, pivotable at both ends to minimize friction. The slot 228 provides a take-up of extra travel of lock. In one embodiment, the latch 212 is generally A-shaped for providing a simple latching structure capable of pendulum like movement, for appropriate integrity and improved locking.

The lock of the present invention can vary widely, and can include for example a tubular lock for appropriate security, depending on the application.

In FIG. 29, latch stoppers 320 and 322 are shown, to insure proper location of the latch and to resist pulling effects from the door or during attempted break-ins. The latch stoppers 320 and 322 in a common casting, and can be connected to a curb or road side wall. This structure is particularly advantageous when used with an A-shaped latch 212, as detailed above.

In a preferred embodiment, the linkage mechanism 218 and pivotable arm 210 are turned beyond center, approximately from about 5 degrees to about 15 degrees, to provide a rigid link. The latch is shown with a receptacle 242 with a substantially flat contact area, to disperse the force during an attempted break-in and terminates with a catch or lip 326 to resist pull-out of the door 204. The flat contact area is at an angle to direct a force into the lock through the pin, and create a couple between the pivot and latch stopper 320, for improved security.

In FIG. 30, the lock is shown in an unlocked position. A left portion of the A-shaped latch 212 is shown flush with the housing. More specifically, the latch stopper 320 positions the latch 212 in a substantially flush position, to provide a predetermined clearance from the adapter 241. A quick lock handle 338 is shown, which is easily accessible and can be slid into the locked or unlocked position, typically when holding the lock during installation. Advantageously, the lock 200 is portable, and easily installable and removable, as illustrated in this and the other figures.

FIG. 31 is a sectional view of the lock housing 212, showing some of the internal components including the linkage mechanism 218 and actuator 206. This structure shows a narrow profile construction, for minimal intrusion into the valuable cargo space of an enclosure and simple construction. Because of it's simple construction and minimal number of parts, it is adapted for mass production, thereby helping to make the system more cost effective. The linkage stacks to the inside, for a narrow profile housing 202. The engagement of the latch 212 with receptacle 242 is substantial, to obstruct entry through the door when locked. And, the ledges 308 and 310 at the inside and outside of the receptacle 242 keep the latch 212 from disengaging.

In FIG. 32, the hook and grab feature 312 is illustrated. A round contour female portion 340 and male portion 342 are shown suitably interconnected. This structure is easily pivotably, connected and disconnected, as shown in phantom lines 344. A quick connect dead bolt like arrangement can securely lock the housing 212 in place through hole 260.

In FIG. 33, the quick connect feature is shown. The fingers 256 mate with a portion 258 of the base plate 236. When loaded, the fingers 256 contact the base 236 to transfer forces from the frame for a secure interconnection. The base is configured to retain the housing via the hole 260. A long and narrow locking pin 344 is shown, terminating with a chamfered portion 342, to facilitate guiding into the hole 260. A snap ring 348 is used to locate the pin 344 when fully extended. A spring 350 pushes the pin 344 in place. The pin 344 can be made in two or more components, to facilitate the automated manufacture thereof. And, a guide block 354 can be used to support an opposite end of the pin 344.

FIG. 34 shows the pin 344 in the retracted position, clearing the base and collapsing the spring 350.

In FIG. 35, the lock housing 202 is remote from the actuator 262. A remote housing 360 is shown with a finger adapted to fit into a mating pocket for ease of installation. A captive screw 362 or other connecting device is used to securely connect the housing 360 to the remote bracket 363. The actuator 262 can be connected to a pivotable arm 368 with a spring detent 364 to hold the arm 368 in place when in the locked position. The cable 246 is connected at connection 366. In use, when arm 368 is rotated counter-clockwise, the cable wire 246 is pulled down through the conduit, which in turn pulls down on the cable plunger assembly 266 and activates the linkage mechanism 218 to lock the latch 212.

In FIG. 36, the latch 212 is shown in the unlocked position. This can be accomplished by rotating the arm 368 clockwise, which releases from the spring detent 364. The cable wire 246 is then pushed up through the conduit, pushing up the plunger assembly 266 and moving the latch structure 212 to the unlocked position.

Figure 37:
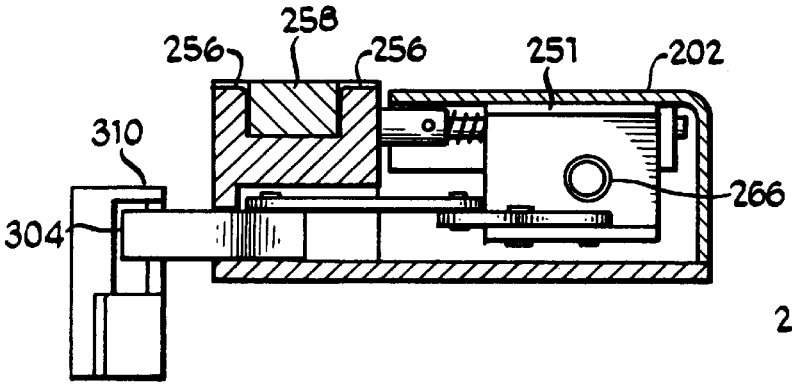
FIG. 37 is a sectional view of an embodiment of the security system for roll-down loading doors with a remote actuator along lines 37—37 in FIG. 35, showing some of the internal components of the lock housing and adapter, in a locked position, in accordance with the present invention.

In FIG. 37, a top view of the housing 202 is shown remote from the actuator.

Figure 38:
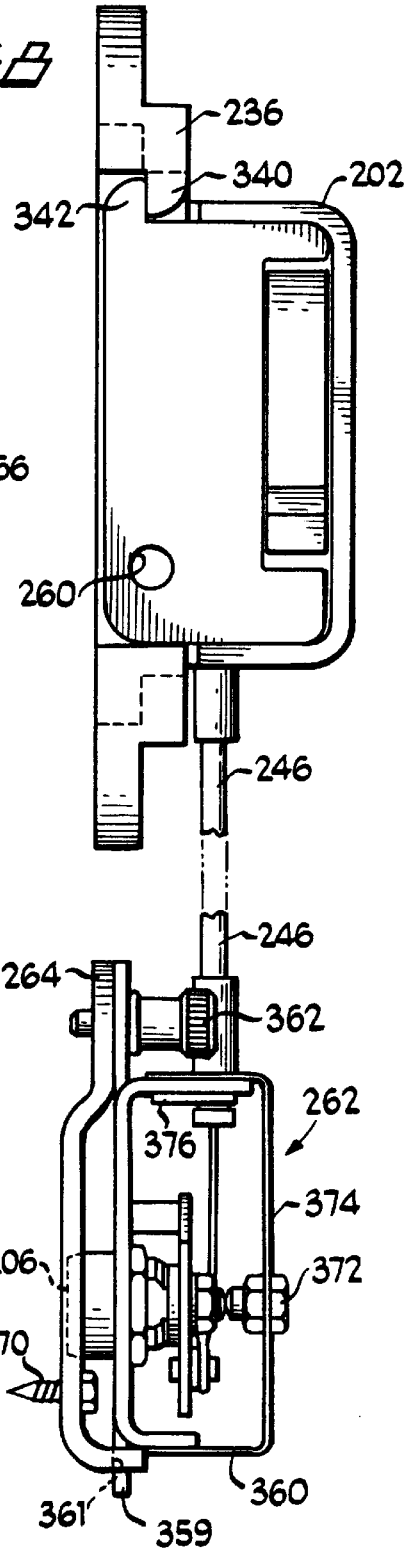
FIG. 38 is a sectional view of an embodiment of the security system for roll-down loading doors with a remote actuator along lines 38—38 in FIG. 36, showing the interconnection of the lock adapter and remote actuator and adapter, in accordance with the present invention.

In FIG. 38, a simplified sectional view of an embodiment of the security system for roll-down loading doors with a remote actuator, illustrating the interconnection of the base plate 236 and lock housing 202 and remote actuator 262 and adapter 264. The remote housing 360 is installed by inserting a tab 359 into the pocket 361. Thereafter, it is rotated upwardly and a screw 362 is suitably tightened into the bracket 264. The keylock is accessible through the door and bracket. Mounting screws 370 can connect the bracket 264 appropriately. A keylock stop assembly or anti-punch out assembly 373 can be used to prevent the tumbler from being hammered out of the actuator 206 (when tampered with). Further, the screw 370 can be pulled away, resulting in the actuator 262 swinging to the side, for improved tamper resistance because of the thief's inability to access the actuator 206 (key receptacle) through the hole.

Also shown in FIG. 38, is an anti-punch out mechanism 372. If the lock is punched with a rod from outside, this structure helps to maintain the integrity of the internal components of the lock. It is also shown with a protective cover 374 and cable keeper plate 376.

Figure 39:
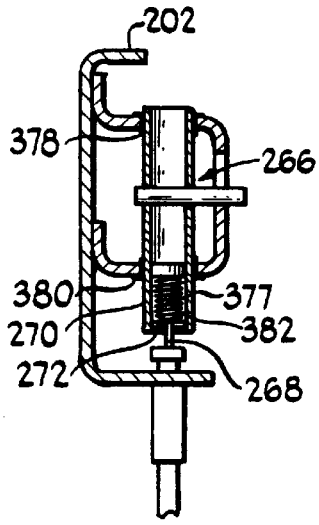
FIG. 39 is a simplified, sectional view of an embodiment of the security system for roll-down loading doors with a remote actuator along lines 39—39 in FIG. 35, showing a coupling of a push-pull cable and linkage, in a locked condition, in accordance with the present invention.
Figure 40:
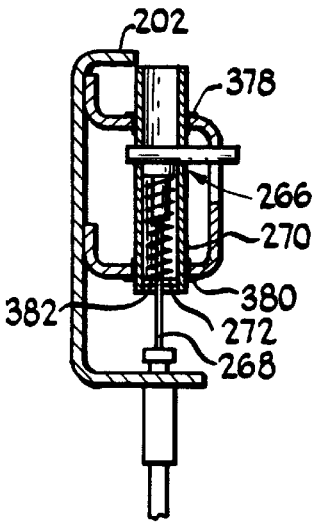
FIG. 40 is a simplified, sectional view of an embodiment of the security system for roll-down loading doors with a remote actuator along lines 39—39 in FIG. 36, showing a coupling of a push-pull cable and linkage, in an unlocked condition, in accordance with the present invention.

FIG. 39 is a simplified, sectional view of an embodiment of the security system for roll-down loading doors with a remote actuator along lines 39—39 of the lock housing 202 in FIG. 36, defining a plunger assembly 266. This figure also shows a coupling of a push-pull cable and linkage, in a locked condition. FIG. 40 shows the plunger assembly in an unlocked condition. The figures show plunger guides 377, for guiding the plunger assembly 266 up and down. Upper and lower nylon bushings 378 and 380 help to reduce friction, when actuated. In use, the plunger pin activates the lock linkage, which compresses a spring 382 to absorb the excess cable travel. The plunger assembly 266 also is shown housing the components shown therein. In FIG. 40, when the plunger pin is activated, the lock linkage is moved. The cable wire end pushes up the plunger pin. The spring 382 allows for more movement of the cable and less movement of the plunger assembly 266. Also shown, are a cable portion 268, cable fitting 270 and e-ring 272, for providing an interface between the cable and plunger assembly 266.

Figure 41:
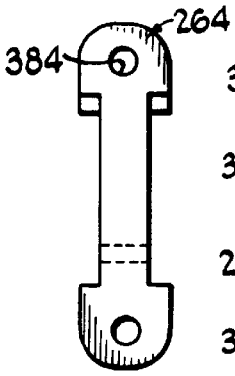
FIG. 41 is an embodiment of the security system for roll-down loading doors showing a front view of a mounting base for the lock housing, in accordance with the present invention.
Figure 42:
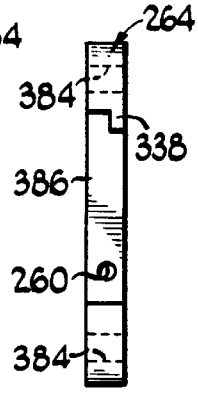
FIG. 42 is an embodiment of the security system for roll-down loading doors showing a side view of a mounting base for the lock housing, in accordance with the present invention.

FIGS. 41–42 show an embodiment of the security system for roll-down loading doors showing an adapter 264 or mounting bracket for the lock housing. A front view is shown in FIG. 41 with two spaced mounting holes 384, for mounting and resistance to rotation, and a narrow middle section 386 to receive the lock. This structure provides a minimal size, weight and casting cost. FIG. 42 is a side view, showing a narrow profile, and includes upper tab 338 for a pivotal connection to the lock and a lower hole 260, for receiving a locking pin when slid in place.

Figure 43:
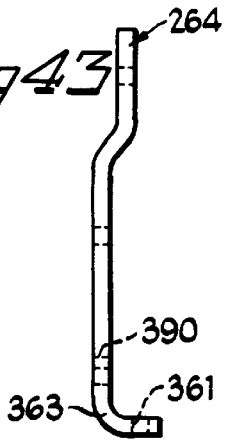
FIG. 43 is an embodiment of the security system for roll-down loading doors showing a side view of the remote mounting bracket for the remote actuator in FIG. 38, in accordance with the present invention.
Figure 44:
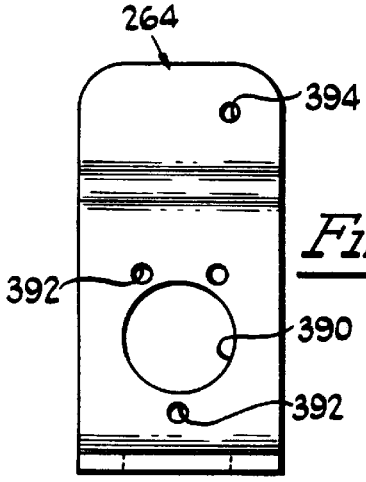
FIG. 44 is an embodiment of the security system for roll-down loading doors showing a front view of the remote mounting bracket for the remote actuator in FIG. 38, in accordance with the present invention.

In FIGS. 43 and 44, a side and front view of the remote bracket 363 is shown. It includes a narrow profile, a slot or open pocket 361 adapted to accept a lower section (ie. tab 359) of the remote housing 360 and has a clearance hole 390 for allowing the keylock therethrough, attachment screw holes 392 and a threaded hole 394 for receipt of a fastening thumb screw (ie. captive screw 362). This construction is low cost and easy to manufacture.

Although various embodiments of the invention have been shown and described, it should be understood that various modifications and substitutions, as well as rearrangements and combinations of the preceding embodiments, can be made by those skilled in the art.

What is claimed is:

1. A security system for roll-down loading doors, comprising:

a substantially narrow profile housing adapted to being connected to a wall of a cargo carrying enclosure, the housing includes a spring lock assembly to facilitate connection to the wall;

an actuator having a key receptacle including a pivotable arm, for moving a latch structure between a locked position and an unlocked position;

the latch structure being generally triangular with a top portion being hingably connected to the housing with a stationary pivot pin and the actuator being coupled by a linkage mechanism, the latch structure is adapted to be connected to a loading door of a cargo carrying enclosure when the latch structure is in the locked position and withdrawn from the door when the latch structure is in the unlocked position; and the linkage mechanism includes a distal section having a port and a proximal section having a second port, the distal section is coupled to a middle portion of the latch structure with a first pivot pin and the proximal section is coupled with the linkage mechanism with a second pivot pin, the linkage mechanism and pivotable arm define a substantially rigid link defined by the linkage mechanism and pivotable arm being substantially aligned when the latch structure is in the locked position and the linkage mechanism and pivotable arm being substantially perpendicular when the latch structure is in the unlocked position.

2. The security system of claim 1, wherein the housing includes a base plate substantially configured to at least partially receive a portion of the housing.

3. The security system of claim 1, wherein the actuator is connected to the housing through a cable assembly defining a remote actuator and includes a plunger assembly with plunger guides having bushings, for guiding the plunger assembly with minimal friction during movement.

4. The security system of claim 1, wherein the latch structure includes at least one generally downwardly extending member with an end portion coupleable with a complementarily configured receptacle for receiving the end portion in a portion of a door of a container, to provide a self-engaging angle for a lock.

5. The security system of claim 1, wherein the housing includes a spring lock assembly including a retracted position to facilitate connection to a wall and an extended position for providing a disconnectable connection to the wall.

6. The security system of claim 1, wherein the actuator is connected to the housing through a cable assembly defining a remote actuator, and the linkage mechanism includes a substantially triangularly mechanism having a first pivot pin connected to the linkage mechanism, a second-middle pivot pin connected to an intermediate frame of the housing and allowing pivotable movement thereof and a third pivot pin connected to a plunger assembly.

7. The security system of claim 6, wherein the plunger assembly includes a spring, cable fitting and e-ring.

8. A security system for roll-down loading doors, comprising:

a substantially narrow profile housing adapted to being connected to a wall of a cargo carrying enclosure;

an actuator having a key receptacle including a pivotable arm, for moving a latch structure between a locked position and an unlocked position;

the latch structure being generally A-shaped with a top portion being hingably connected to the housing with a stationary pivot pin and the actuator being coupled by a pivotable arm, the latch structure is adapted to be connected to a loading door of a cargo carrying enclosure when the latch structure is in the locked position and withdrawn from the door when the latch structure is in the unlocked position, the latch structure includes at least one generally downwardly extending member with an end portion couplable with a complementarily configured receptacle for receiving the end portion in a portion of a door of a container, to provide a self-engaging angle for a lock; and the pivotable arm includes a distal section having a port and a proximal section having a second port, the distal section is coupled to a middle portion of the latch structure with a first pivot pin and the proximal section is coupled with the pivotable arm with a second pivot pin, the pivotable arm defines a substantially rigid link defined by the pivotable arm being substantially aligned when the latch structure is in the locked position and the pivotable arm not substantially aligned when the latch structure is in the unlocked position.

9. A security system for roll-down loading doors, comprising:

a substantially narrow profile housing adapted to being connected to a wall of a cargo carrying enclosure;

an actuator having a key receptacle including a pivotable arm, for moving a latch structure between a locked position and an unlocked position;

the latch structure being generally A-shaped with a top portion being hingably connected to the housing with a stationary pivot pin and the actuator being coupled by a linkage mechanism, the latch structure is adapted to be at least partially received in a door of a cargo carrying enclosure when the latch structure is in the locked position and withdrawn from the door when the latch structure is in the unlocked position;

the pivotable arm includes a distal section having a port and a proximal section having a second port wherein the second port is substantially oblong, the distal section is coupled to a middle portion of the latch structure with a first pivot pin and the proximal section is coupled with the linkage mechanism with a second pivot pin, the pivotable arm defines a substantially rigid being substantially aligned when the latch structure is in the locked position and not substantially aligned when the latch structure is in the unlocked position;

the housing includes a base plate substantially configured to at least partially receive a portion of the housing;

the latch structure includes at least one generally downwardly extending member with an end portion couplable with a complementarily configured receptacle for receiving the end portion in a portion of the wall of a container, to provide a self-engaging angle for a lock; and the housing includes a spring lock assembly to facilitate connection to a wall.

10. The security system of claim 9, wherein the housing includes a spring lock assembly including a retracted position to facilitate connection to a wall and an extended position for providing a disconnectable connection to the wall.

11. The security system of claim 9, wherein the actuator is substantially located in the housing.

12. The security system of claim 9, wherein the actuator is connected to the housing through a cable assembly defining a remote actuator.

13. The security system of claim 9, wherein the actuator is connected to the housing through a cable assembly defining a remote actuator, and the linkage mechanism includes a substantially triangularly mechanism having a first pivot pin connected to the linkage mechanism, a second-middle pivot pin connected to an intermediate frame of the housing and allowing pivotable movement thereof and a third pivot pin connected to a plunger assembly, the locked position being defined by moving the first pivot pin downwardly and the unlocked position being defined by moving the first pivot pin upwardly via the cable assembly.

14. The security system of claim 9, wherein the actuator is connected to the housing through a cable assembly defining a remote actuator and includes a plunger assembly with plunger guides having bushings, for guiding the plunger assembly with minimal friction during movement.

15. The security system of claim 9, wherein the actuator is connected to the housing through a cable assembly defining a remote actuator, the remote actuator includes a plunger assembly with a spring, cable fitting and e-ring.

* * * * *